US012013220B2

(12) United States Patent
Bruno

(10) Patent No.: US 12,013,220 B2
(45) Date of Patent: Jun. 18, 2024

(54) AMMUNITION CARTRIDGE WITH A BASE PLUG VENT

(71) Applicant: NOSTROMO HOLDINGS, LLC, Alexandria, VA (US)

(72) Inventor: Nicolas Horacio Bruno, Arundel, ME (US)

(73) Assignee: NOSTROMO, LLC, Kennebunk, ME (US)

( * ) Notice: Subject to any disclaimer, the term of this patent is extended or adjusted under 35 U.S.C. 154(b) by 0 days.

(21) Appl. No.: 18/300,626

(22) Filed: Apr. 14, 2023

(65) Prior Publication Data

US 2023/0417524 A1 Dec. 28, 2023

Related U.S. Application Data

(62) Division of application No. 15/809,384, filed on Nov. 10, 2017, now abandoned.

(Continued)

(51) Int. Cl.
*F42B 39/20* (2006.01)
*F42B 5/02* (2006.01)

(Continued)

(52) U.S. Cl.
CPC ..... *F42B 39/14* (2013.01); *F42B 5/02* (2013.01); *F42B 33/00* (2013.01); *F42B 33/02* (2013.01); *F42B 39/20* (2013.01)

(58) Field of Classification Search
CPC .... F42B 5/26; F42B 5/28; F42B 5/285; F42B 5/36; F42B 39/20
See application file for complete search history.

(56) References Cited

U.S. PATENT DOCUMENTS 3,406,630 A 10/1968 Muller
5,216,965 A 6/1993 Liptak et al.

(Continued)

FOREIGN PATENT DOCUMENTS

DE 102011014402 A1 9/2012
DE 202014105939 U1 1/2015

(Continued)

OTHER PUBLICATIONS

"IM Solutions for Projectiles Crimped to Cartridges for Artillery Application—Phase II, Transition from Cartridge Case Venting to Insensitive Propellant" by Carl J. Campagnuolo, Christine M. Michienzi, Edward G. Tersine, Christine D. Knott, William J. Andrews—NDIA IM/EM Symposium, May 11-14, 2009.

(Continued)

*Primary Examiner* — Jonathan C Weber
(74) *Attorney, Agent, or Firm* — Philip E. Levy; Taera R. Franklin; Eckert Seamans Cherin & Mellott, LLC

(57) ABSTRACT

An ammunition cartridge comprised of a projectile inserted in, and mechanically connected to, a metal cartridge case assembly having a propulsion chamber and a base, and an energetic propellant disposed in the propulsion chamber, includes a base plug in which is mounted an igniter with an energetic primer. During manufacture of the cartridge, a fusible support ring is incorporated into a metal cavity. The cartridge base includes a cavity allowing the fusible material to solidify at ambient temperatures. When exposed to heat from an external fire, the fusible support plug liquefies losing its strength and subsequently, when a propellant or primer off-gasses or auto-ignites the pressure from the reaction ejects a metal plug or lid from the cartridge case base, creating a void that allows the propellant and primer to combust in an unconfined space.

13 Claims, 15 Drawing Sheets

Related U.S. Application Data

(60) Provisional application No. 62/422,098, filed on Nov. 15, 2016.

(51) Int. Cl.

| | |
|---|---|
| ***F42B 33/00*** | (2006.01) |
| ***F42B 33/02*** | (2006.01) |
| ***F42B 39/14*** | (2006.01) |

(56) References Cited

U.S. PATENT DOCUMENTS

| | | | |
|---|---|---|---|
| 5,311,820 | A | 5/1994 | Ellingsen |
| 5,936,189 | A | 8/1999 | Lubbers |
| 7,322,295 | B1 | 1/2008 | Haeselich |
| 7,624,888 | B1 | 12/2009 | Pudlak et al. |
| 8,028,826 | B1 | 10/2011 | Woo et al. |
| 8,322,286 | B2 | 12/2012 | Toreheim et al. |
| 8,381,656 | B1 | 2/2013 | Woo et al. |
| 8,505,456 | B2 | 8/2013 | Haeselich |
| 8,550,004 | B1 | 10/2013 | Woo et al. |
| 8,573,127 | B2 | 11/2013 | Sullivan et al. |
| 8,720,722 | B2 | 5/2014 | Sunday et al. |
| 8,925,463 | B1 | 1/2015 | Sullivan et al. |
| 9,410,782 | B2 | 8/2016 | Bruno et al. |
| 9,995,563 | B2 | 6/2018 | Redeker et al. |
| 2012/0204750 | A1 | 8/2012 | Sullivan et al. |
| 2013/0248383 | A1 | 9/2013 | Kotevski et al. |
| 2013/0291754 | A1 | 11/2013 | Kotefski et al. |
| 2015/0000546 | A1 | 1/2015 | Kotefski et al. |
| 2017/0299361 | A1 | 10/2017 | Redeker et al. |

FOREIGN PATENT DOCUMENTS

| | | | |
|---|---|---|---|
| DE | 102014005997 | B3 | 3/2015 |
| DE | 10 2014 001576 | A1 | 8/2015 |
| KR | 2013143175 | A | 12/2013 |
| WO | 2011/071576 | A1 | 6/2010 |
| WO | 2012/126554 | A1 | 9/2012 |
| WO | 2013/180739 | A1 | 12/2013 |
| WO | 2013180739 | A1 | 12/2013 |
| WO | 2014047260 | A1 | 3/2014 |
| WO | 2014/197079 | A1 | 12/2014 |
| WO | 2015/165780 | A1 | 11/2015 |
| WO | 2018/093701 | A1 | 5/2018 |

OTHER PUBLICATIONS

NATO publication RTO-EN-023, "Combustions of Solid Propellants" by G Lengelle, J. Duterque and J.F. Tumbert from the National Aerospace Research Institute (ONERA) in France, published in May 2002.

International Search Report issued in PCT/US2017/061232, dated Jan. 19, 2018.

Written Opinion issued in PCT/US2017/061232, dated Jan. 19, 2018.

AMMUNITION CARTRIDGE WITH A BASE PLUG VENT

CROSS-REFERENCE TO RELATED APPLICATIONS

This application is a divisional of U.S. application Ser. No. 15/809,384, filed Nov. 10, 2017, entitled "AMMUNITION CARTRIDGE WITH A BASE PLUG VENT", which claims priority from the U.S. Provisional Application No. 62/422,098 filed Nov. 15, 2016, each of which are incorporated herein in their entirety.

BACKGROUND OF THE INVENTION

The present invention relates to an ammunition cartridge incorporating a venting system in the munition's base, a method to manufacture the cartridge case and a package configuration to store and transport vented ammunition cartridges.

INTRODUCTION

The term "Insensitive Munitions" refers to a generic body of munitions knowledge that includes guidance practices, regulations, technology, methodologies and standards for complying with the following objective:

"To ensure, to the extent practicable, that munitions under development or procurement are safe throughout development and fielding when subject to unplanned stimuli. IM are those munitions that reliably fulfill their performance, readiness, and operational requirements on demand, and that minimize the probability of inadvertent initiation and the severity of subsequent collateral damage to weapon platforms, logistic systems, and personnel when subjected to selected accidental and combat threats." 10 U.S.C. 141, § 2389

Insensitive Munitions ("IM") technology includes new energetic materials with less sensitivity to unplanned stimuli as well as mechanical and functional designs that mitigate the undesired reactions against such unplanned stimuli. Two key IM tests required by the U.S. Department of Defense ("DOD") in qualification of ammunition are slow cook-off and fast cook-off tests where the ammunition is exposed to heat and/or fire and the results are documented. DoD's requirement to identify new safety technology that can be broadly incorporate into an array of munitions remains a primary goal, this application focuses on applying venting solutions in a narrow range of ordnance, gun fired ammunition cartridges.

Accordingly, it is desired that an ammunition cartridge will not exhibit a substantial reaction when naked or packaged ammunition cartridges are heated when exposed to an external fuel fire event which is, for the purpose of this specification, identified as an emergency mode.

While we intend to introduce new survivability technology into ammunition cartridges, all cartridges must continue to function in all normal operational modes, being fired from a cannon or machine gun. Normal modes of operation include:

A— Logistics Package Storage
B— Tactical Stowage
C— Feeding
C—Chambering
D—Function Fire
E—Extraction
F— Ejection of a "Spent" cartridge case

PRIOR ART

The prior art in the field of Insensitive Munitions and venting of ammunition propulsion includes a number of articles and patents that are relevant to the present invention. Typical of such prior art is the U.S. Pat. No. 5,936,189 to Lubbers and an article "IM Solutions for Projectiles Crimped to Cartridges for Artillery Application—Phase II, Transition from Cartridge Case Venting to Insensitive Propellant" by Carl J. Campagnuolo, Christine M. Michienzi, Edward G. Tersine, Christine D. Knott, William J. Andrews—NDIA IM/EM Symposium, May 11-14, 2009.

Also relevant are the following prior art patents:

1. U.S. Pat. No. 7,322,295 (Haeselich) introduced modifications and configuration of venting cartridge cases using a fusible material in a channel.
2. U.S. Pat. No. 8,028,826 teaches use of a unique internal packaging configuration for 25 mm ammunition allowing for venting of cartridge cases using a high density package methodology.
3. U.S. Pat. No. 8,322,286 discloses a "contracting" memory metal incorporated into the base of a projectile's propulsion allowing for venting.
4. U.S. Pat. No. 8,381,656 discloses a cartridge or grenade venting mechanism that uses interlocking components coupled with a fusible material that liquefies at elevated temperatures, releasing a encapsulated spring imparting a rotational force that activates a vent.
5. U.S. Pat. No. 8,550,004 teaches an insensitive cartridge munition having a base plug in the cartridge case. The base plug is held in place by a "separate solder" that, at elevated temperatures, releases the base plug, thus providing a void for venting propellant gasses.
6. U.S. Pat. No. 8,573,127, entitled "Pressure Relief System," discloses embodiments for partially or fully encapsulating a fusible material or plug that loses strength at elevated temperatures thus providing a method of venting a cartridge case.
7. WO 2012/126554A1, also published as DE 10 2011 014402 A1 and EP2686636 A1 and B1 disclose a solid base plug crimped or riveted with a fusible material that is configured in a channel in the manner taught in U.S. Pat. No. 8,573,127. The device retains the base plug in position during normal operating conditions, but at elevated temperatures a bismuth tin material releases the plug from a channel.
8. U.S. Pat. No. 8,720,722, entitled "Venting Mechanism for Containers," teaches a design to vent containers.
9. U.S. Pat. No. 8,925,463 discloses the use of expanding memory metal, incorporated into a munition's cartridge case, that releases a base plug with a primer. This patent provides a useful discussion of the operating context and requirements for cartridge case operating and venting in emergency storage or cook-off conditions.
10. U.S. Pat. No. 9,410,782 teaches use of an encapsulated spring fitted into the ogive of a projectile that, upon reaching an elevated temperature, mechanically separates the fuze from the warhead, thus venting and separating the detonator or booster from the primary explosive.
11. DE 10 2014 001576 A1 published 2 Feb. 2014 is very similar to U.S. Pat. No. 8,925,463 as it uses a memory metal in combination with a fusible material.

In addition, a great deal of prior art exists for general use of a base plug in munitions, especially in calibers such as 40×53 mm, where fittings for base plugs are often incorporated into cartridge cases forming dual chamber systems. The U.S. Army's M169 40×53 mm propulsion system has a design, allowing for loading of the cartridge case during manufacture, whereby a base plug is fitted to form a high-pressure chamber and, after a propellant is loaded, the primer is inserted into the base plug affixed to a cartridge case. In some circumstances it is advantageous to minimize disruption of well-established supply chains by swapping out existing crimped base plug designs with crimped base plug safety vents configured within a base plug.

Notwithstanding the forgoing references which are applicable to gun fired ammunition cartridges, most prior art venting concepts vent other types of munitions such as large artillery projectiles, bombs, shoulder launched rockets and large tactical rocket motors.

When considering venting of ammunition cartridge, some additional technical context is useful to understand how propellants react when heated. In most cases, auto-ignition of propellants in confinement initiates violent deflagration of medium caliber projectiles.

Solid Propellant Combustion in Confinement

A principal goal in Insensitive Munitions (IM) technology development is the mitigation of violent events where munitions are exposed to external fires. Most modern military ammunition cartridge use modern double-based propellants. It is important to understand some fundamental principles regarding propellants when developing technologies in this field. There are a number of excellent teaching references regarding combustion of solid propellants. One such reference is the NATO publication RTO-EN-023, *"Combustions of Solid Propellants"* by G Lengelle, J. Duterque and J. F. Tumbert from the National Aerospace Research Institute (ONERA) in France, published in May 2002. This NATO report provides excellent graphics and detail explaining how propellants will burn at different efficiency rates with varying atmospheric pressures. When combustion takes place in a confined state, reactions become more violent and the reaction releases more energy.

Fortunately, it is possible to vent combustion chambers, such that burning propellants do not pressurize combustion chambers. Hence, venting of a high-pressure chamber in an emergency condition, such as a fire, leads to reduced energy being released by unconfined propellant combustion.

Off-Gassing and Differential Thermal Analysis

When propellants are heated, solid propellants exhibit a phenomenon known as "off-gassing" or "out-gassing." Double-base gun propellants typically contain nitrocellulose and nitroglycerine with small amounts of stabilizers and binders. Nitrogen dioxide (NO2), a corrosive gas, and other oxides of nitrogen, are generated in the heating of double-based propellants. The release of results in increased pressures in a confined environment, but the amount and types of gases produced by heating vary greatly. The density of solid propellant in a volume, the type of propellant, age and storage conditions of the propellant, all influence the amount of off-gassing exhibited. The amount of off-gassing and pressurization of a chamber is therefore difficult to predict without exact control of all the variables.

SUMMARY OF THE INVENTION

A principal objective of the present invention is to provide a robust ammunition cartridge configuration that will vent the propulsion component of ammunition cartridges in order to minimize collateral damage that results from an auto-igniting propellant when ammunition cartridges are heated by an external fire.

It is a further objective of the present invention to disclose a novel manufacturing process to configure vents incorporated into the base of ammunition cartridges.

It is a further objective of the present invention to provide an improved method for inserting and retaining a base plug with a venting system into a cartridge munition.

It is a further objective of the present invention to provide a cartridge munition that is designed to vent gases under high pressure from cartridge case and, at the same time, to physically separate the igniter (primer or flash tube) from the propellant with the first energetic event.

It is a further objective of the present invention that, upon primer initiation (first energetic event) in either a slow or fast cook-off, a vent mass (base plug) is ejected and an optimized vent void leads to a less efficient propellant burn (second energetic event).

It is a further objective of the present invention to provide a cartridge munition of the above-noted type with an effective and reliable solution to vent propellant gases from the cartridge case in the event the cartridge munition is exposed to temperatures that reach or exceed auto-ignition temperatures of the primer, igniter and/or propellant.

It is yet another objective of the present invention to provide an ammunition package configuration for cartridge munitions that facilitates the venting from the ammunition package into the atmosphere of such munitions fitted with special vent plugs.

These objectives, as well as additional objectives which will become apparent from the discussion that follows, are achieved, according to the invention, by providing a cartridge munition comprised of a projectile inserted in, and mechanically connected to, a metal cartridge case having a propulsion chamber and a base, and an energetic propellant disposed in the propulsion chamber. The cartridge base has an internal cavity that is provided with a solid plug in which is mounted an igniter with an energetic primer. During manufacture of the cartridge, the base plug is affixed in the cartridge using a process of injection molding a fusible material through one or more passages into a metal cavity, where the material cools and forms a fusible support for the plug. The fully assembled ammunition cartridge functions in normal operational modes; however, when the cartridge is exposed to external heating the fusible support for the plug loses mechanical strength and an unsupported cartridge, clear of obstructions, vents gases from the base of the cartridge.

The fusible material, which may be a metal or a polymer, is selected so that the cartridge case assembly loses mechanical strength and structural integrity at elevated temperatures such that, when the propellant or primer off-gasses or otherwise pressurizes the propulsion chamber, for example, by auto-igniting, the base plug or lid is ejected from the cavity at the base of the cartridge case, creating a void that allows the ignited primer or propellant to burn itself out in an unconfined space.

A typical ammunition cartridge is comprised of a projectile inserted into the cartridge case that is mechanically connected thereto via crimping or alternative means. Normally, a projectile and cartridge case has a propulsion chambers that contains a solid propellant. The cartridge case includes a primer or igniter in the head or base of the cartridge case. The cartridge case may include one or multiple chambers for ignition, combustion and expansion. A base plug can be used to close a high pressure chamber in a cartridge case. Effective combustion of the propulsion requires containment to optimize burning of the propulsion.

An objective of this design, according to the invention, in an emergency situation, is to allow for activation of a vent creating a channel that is created when the base plug or a base plug component is ejected from the cartridge case, such that the vented high pressure chamber precludes auto-igniting propellant powders from burning in a pressurized environment within a cartridge case.

Accordingly, the safer IM cartridge case, when exposed to heating by a fire, activates an emergency vent that creates a passage at the base of the cartridge case, where any auto-igniting energetic materials eject and vent rearward clear of the propulsion chamber allowing propellant gases to exit through the base plug or through the head of the cartridge case.

Where such a system is incorporated into a dual-chamber propulsion system, and a cartridge is subjected to heating in an emergency storage mode, the fusible material supporting the base plug incorporated into the base of a cartridge case weakens. Off-gassing or combustion of an energetic, such as the propellant, acts to expel part or all of the base plug from the sealed cartridge case assembly. This action, in combination, creates an activated vent channel at the base of the cartridge case.

It would be beneficial, according to the invention, to also couple this propulsion venting system, with a methodology to vent warheads of the type disclosed in the U.S. Pat. No. 9,410,782.

A cartridge case assembly normally has at least two non-fusible components. These include:

A cylindrical cartridge case with a hole at the base for a base plug, and

A base plug with a pocket for a primer or igniter.

According to the invention, the contours at the surfaces the metal non-fusible cylindrical case and a non-fusible base plug provide a cavity with voids and ports that facilitate injection of a fusible material into a cavity where the metal parts act to mold a fusible material. This cavity connects to voids that form one or more passages that facilitate injection of a heated, fusible fluid into the cavity during manufacture. Further cooling of the fusible material to ambient temperatures results in formation of a solid fusible support for the base plug configured in the cartridge case assembly. Subsequent ammunition cartridge fabrication steps are completed in ambient conditions, after injection molding of the cartridge case and will normally include (1) crimping of the projectile to a cartridge case, (2) propellant loading and (3) seating of a primer to close the cartridge case. This fully assembled ammunition cartridge, configured with a fusible material supporting the base plug thus incorporates a melting point that is higher than the operational temperature of the ammunition and lower than the auto-ignition temperature of the energetics contained in the cartridge, which may be about 130° C., for example.

The base plug houses the primer and/or igniter, whereby the cartridge case assembly:

at normal operating conditions, remains intact through identify modes of use and function, and in an emergency storage condition (when exposed to external heating) the fusible material liquefies, releasing the base plug and compromising confinement of the propellant by creating a large passage or vent hole so that:

(i) the base plug, with a primer, is ejected rearward from the projectile, and (ii) auto-ignition of propellant or primer does not occur in a fixed, confined volume.

Accordingly, in the emergency storage condition, the ignition and expanding gases produced by the burning propellant do not push the projectile forward from the mouth of the cartridge case, at a high velocity.

Where multi-chamber cartridge cases are used, the fusible material in a heated condition releases the vents from the passage and (i) does not vent from orifices between multi-chamber systems, and (ii) does not pressurize the low pressure chamber such that projectiles are ejected at high-velocity from a projectile's case. According to the invention, the size of the venting area is chosen in relation to the propellant load.

If a cartridge munition of the type described herein is heated to the melting temperature of the fusible material or metal—a temperature higher than the operational temperature of the ammunition but below the auto-ignition temperature of the primer, igniter or propellant, for example, in the range of about 115° C.—then the fusible material in the void melts. If the temperature continues to increase and the propellant charte, primer and/or the igniter auto-ignite, almost no significant pressure can build up within the propulsion chamber because the opened, free passages function as pressure-relief apertures.

According to the invention, the cartridge ejects a base plug prior to or simultaneous with energetic auto-ignition, such that combustion occurs in an unconfined space. Propellant combustion in an unconfined space disrupts efficient propellant combustion and reduces the violence, severity and shock associated with propellant auto-ignition. Nevertheless, the disruption of a confined propellant combustion does not completely render safe the ammunition and the auto-ignition of solid propellant powders will still generate gases that must be vented from the rear of the cartridge case. When ammunition cartridges include high explosive projectiles, the disclosed method of propulsion venting may be coupled to a separate, but complementary means of warhead venting as disclosed in the aforesaid U.S. Pat. No. 9,410,782.

The ammunition cartridge according to the invention can use solid metal, polymers or fusible metals in combination. During manufacture of the cartridge munition, the selected fusible metal or polymers liquefies at elevated temperatures allowing for injection via ports into channels and cavities in the cartridge case. In a preferred embodiment, the fusible material is positioned substantially outside the venting channel, surrounding the solid base plug.

The preferred embodiment of the invention does not use temperamental rivets and does not use memory metals. The channels, internally configured by a metal part positioned in a seat, provide for fabrication of an internal polymer internal skirt, similar to an O-ring. Cooling of the cartridge case to ambient temperatures allows the fluid fusible material to solidify during manufacture such that the metal cartridge case and base plug are bonded together. After completing the bonding process, the cartridge case can be loaded with propellant, primer and affixed to a projectile, thereby forming a completed ammunition cartridge with a safety vent configured into the base of the cartridge case.

According to a preferred embodiment of the invention, the fusible material surrounding the base plug includes a plurality of outward projections from the O-ring shape that extend radially into respective openings in the base of the cartridge case. This "retention feature" retains the physical connection of the base plug to the cartridge case during ejection after firing and reducing the energy imparted on the ejected base plug.

In preferred embodiments of the invention, the fusible material is selected to lose mechanical strength at an elevated temperature (1) exceeding the ammunition's maximum storage temperature, and (2) below the temperature where an energetic, confined in a high pressure chamber auto-ignites.

A number of new high-melt temperature polymers can be used to fabricate vented cartridge cases. In some cases, the molding ports may be capped or covered.

The present invention thus provides for an ammunition cartridge having a metal cartridge case, with a base plug that is assembled to create and maintain a confined high pressure chamber within the cartridge case in ambient and operational environments. The same cartridge munition, when subjected to elevated heating, ejects the base plug when an energetic primer igniter or the propellant off-gasses, or an auto-ignition momentarily pressurizes the high pressure chamber.

The ammunition cartridge described above is preferably packaged for transportation and storage in such that combustion gases discharge through an opened vent, after ejection of the base plug, such that the vent channel is not impaired. A preferred embodiment of the packaging arrangement, in accordance with the present invention, allows for venting gases, released intermittently from multiple ammunition cartridge undergoing external heating, allowing for gases to vent from each cartridge case, into the ammunition storage box, and subsequently from the temporarily pressurized ammunition storage box into the atmosphere.

Accordingly, the packaging material used in ammunition containers utilizes packing material that retains form and strength at elevated temperatures and provides an undeterred vent path for release of pressure in the event the base plug is ejected. The package preferably includes dunnage with a configuration allowing for unobstructed venting of the base of the multiple cartridges contained therein, and includes a blow-out panel in a wall of the package that relieves any momentary pressurization within the package by breaking away and allowing gases to vent from a punctured panel into the atmosphere. Advantageously, the dunnage is selected so as not to liquefy or clog vented cartridges.

For a full understanding of the present invention, reference should now be made to the following detailed description of the preferred embodiments of the invention as illustrated in the accompanying drawings.

DESCRIPTION OF THE PREFERRED EMBODIMENTS

The preferred embodiments of the present invention will now be described with reference to FIGS. 1-7 of the drawings. Identical elements in the various figures are designated with the same reference numbers.

Figure 1A:
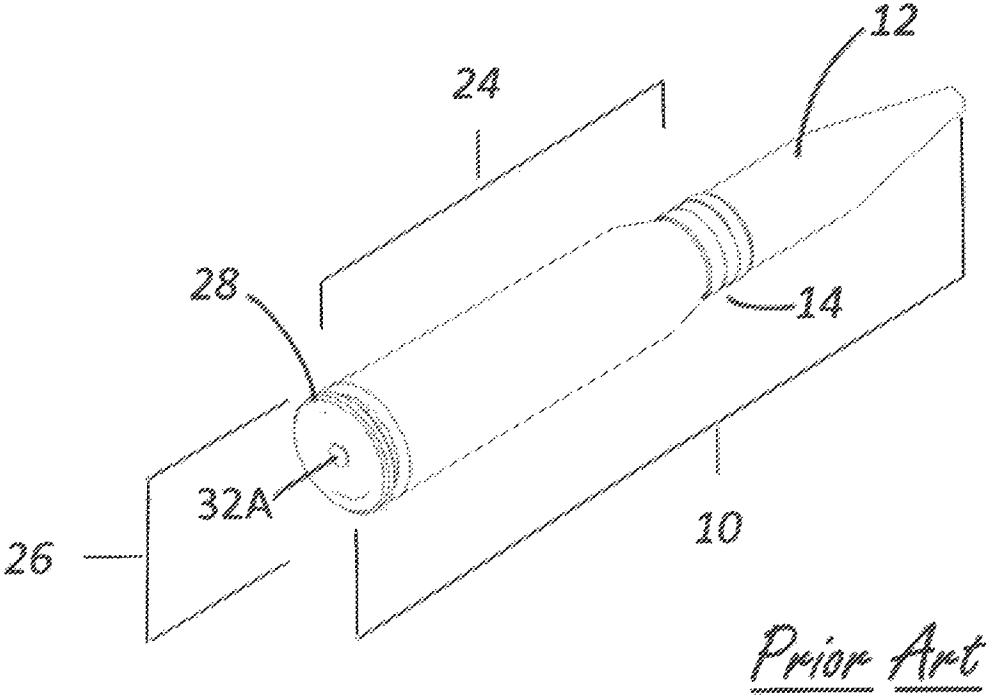
FIG. 1A shows a perspective, external view of a typical 30 mm×173 cartridge detailing typical features.
Figure 1B:
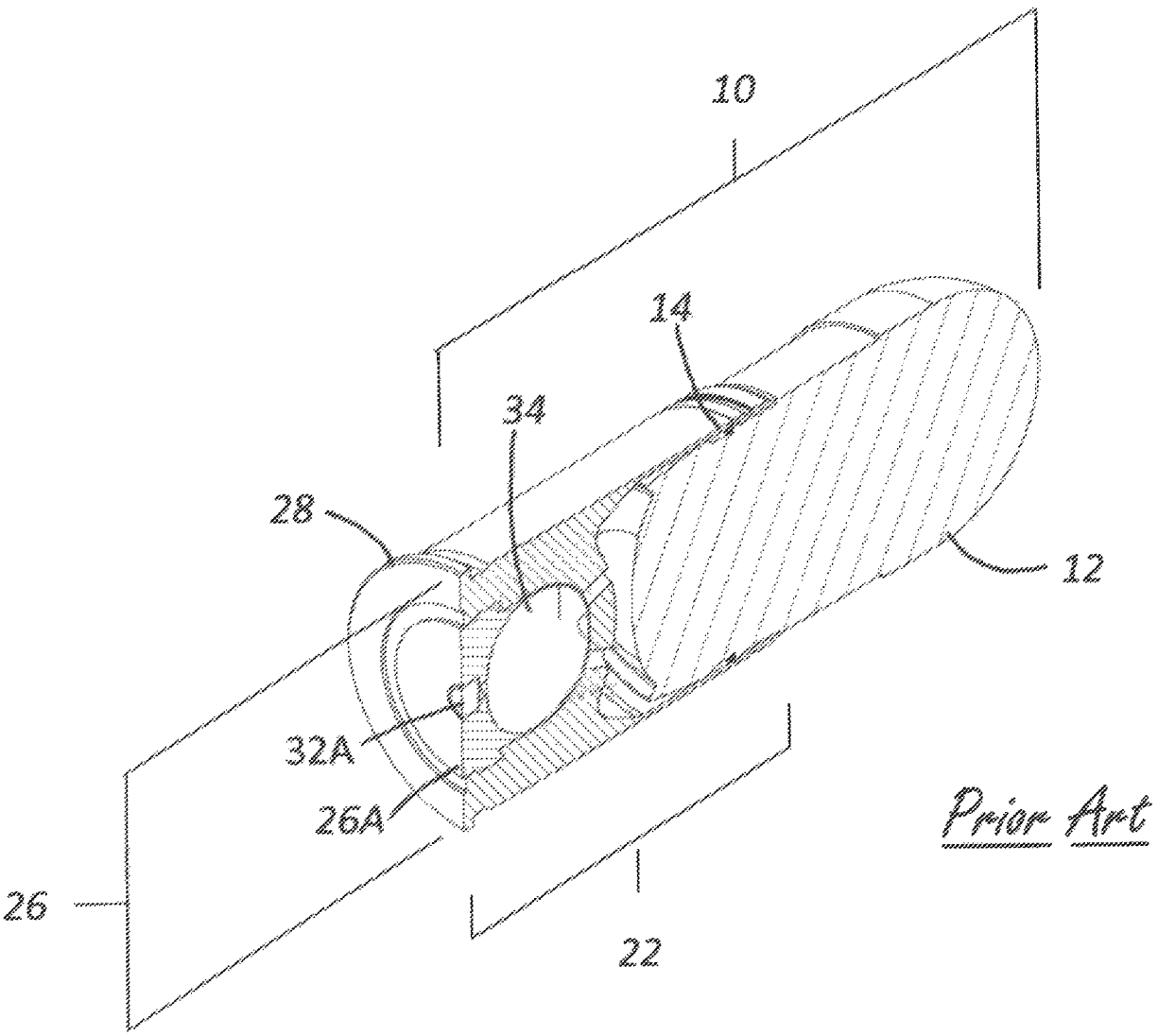
FIG. 1B depicts a perspective cross-sectional view of a typical US 40 mm HV projectile using a US M169 cartridge case assembly. This cartridge case assembly uses a high-low dual chamber system where propellant burns in a high pressure chamber and the pressure at an orifice flows into a low pressure chamber.

To highlight and distinguish the improvement according to the invention from current state of the art, an example of which is illustrated in FIG. 1, FIGS. 2 and 3 depict two typical modes of use for conventional ammunition cartridges 10; namely, a 30 mm configuration and a 40 mm cartridge configuration, respectively. Each cartridge munition 10 incorporates a projectile 12, affixed at 14, to the cartridge case assembly 22.

A typical cartridge is also configured with a propellant 34 that is confined in proximity to the primer or igniter 32A. A typical cartridge case sub-assembly 24 normally includes a rim 28 near the base 26 to facilitate extracting and feeding 110B and cartridge extraction 110E and ejection 110F (FIG. 5). The cartridge case assembly includes the cartridge base 26 that may include a base plug 26A. The improved cartridge according to the invention will continue to function in all modes of use (FIGS. 4 and 5) but will vent the propulsion and/or primer gasses from packaged cartridges when a cartridge or the cartridge package is exposed to heating from an external fire. Desirably, venting will reduce the severity and violence of an energetic event that results from an external fire.

Modes of Use, Configuration (Unpackaged and Packaged) and Venting Improvement

A cartridge munition according to the invention must continue to function in all modes of use (shown in FIG. 5). To this end, such cartridge munitions include a vented cartridge case 16 and improved packaging 102 (shown in FIG. 4) to house the vented cartridge munitions. The packaging provides for a modified logistics storage configuration with special dunnage 104 and blow-out panels 106.

Figure 2A:
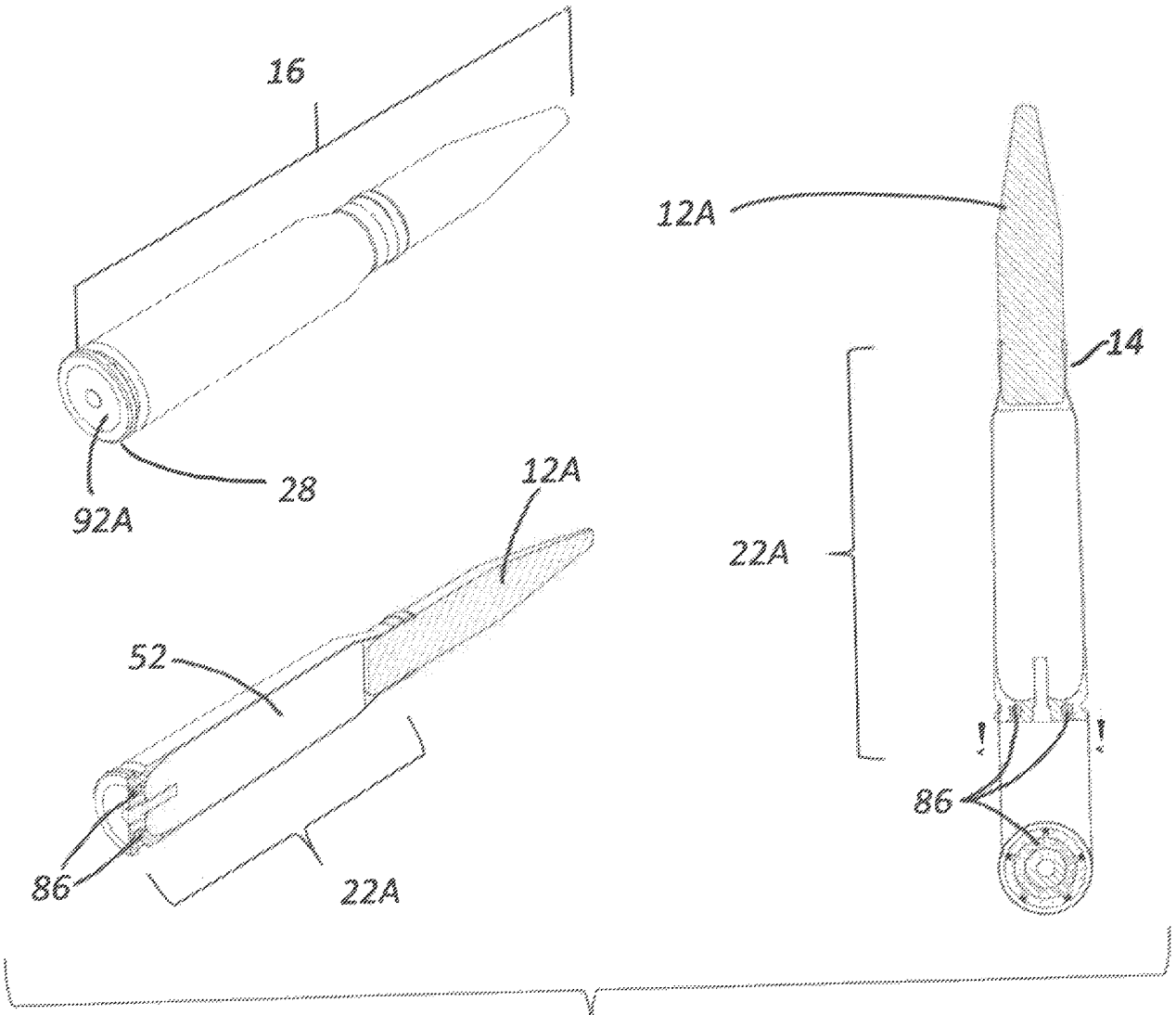
FIG. 2A depicts a 30 mm cartridge with a "fusible support plug," according to the invention, incorporated into the base of the cartridge case.
Figure 2B:
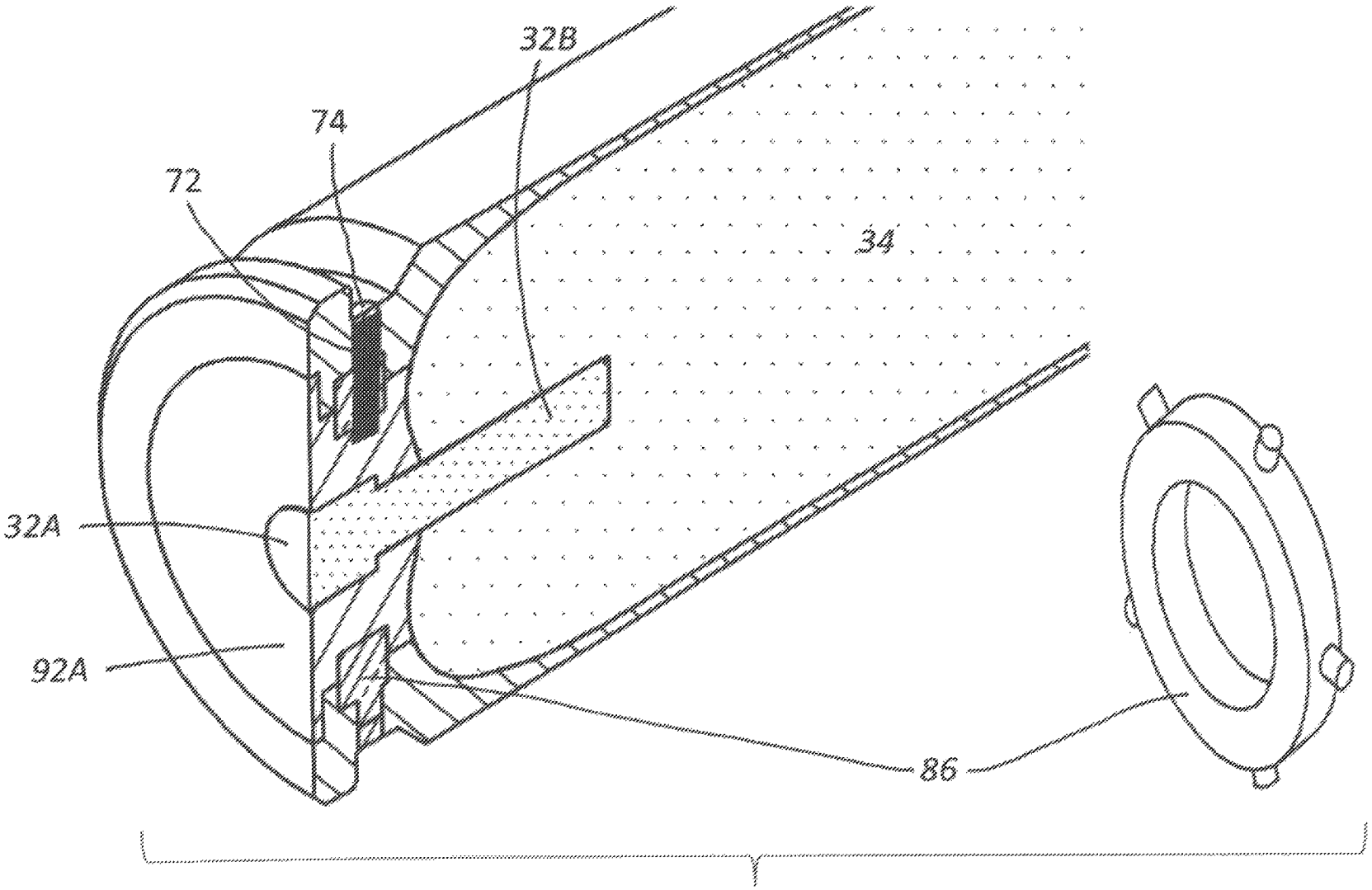
FIG. 2B depicts additional details of 30 mm cartridge of FIG. 2A with a fusible polymer support plug configured in the cartridge's base.

FIG. 2A depicts an improved 30 mm cartridge munition 16 with a projectile 12A and a vented cartridge case 22A. The base of the cartridge case includes a base plug 92A and an incorporated fusible support ring 86. FIG. 2B illustrates how the primer or igniter 32A, are in confined proximity to the propellant 34. The image also depicts an isolated perspective view of the 30 mm base plug 92A incorporating a safety support ring 86 forming a vented cartridge case 22A. A 30 mm cartridge may also include a flash tube 32B to ignite the propellant in the center of the chamber. Typically, a 30 mm cartridge case normally includes one operational chamber filled with propellant 34.

Fabrication of Fusible Support Plugs in Cartridge Cases

Figure 2C:
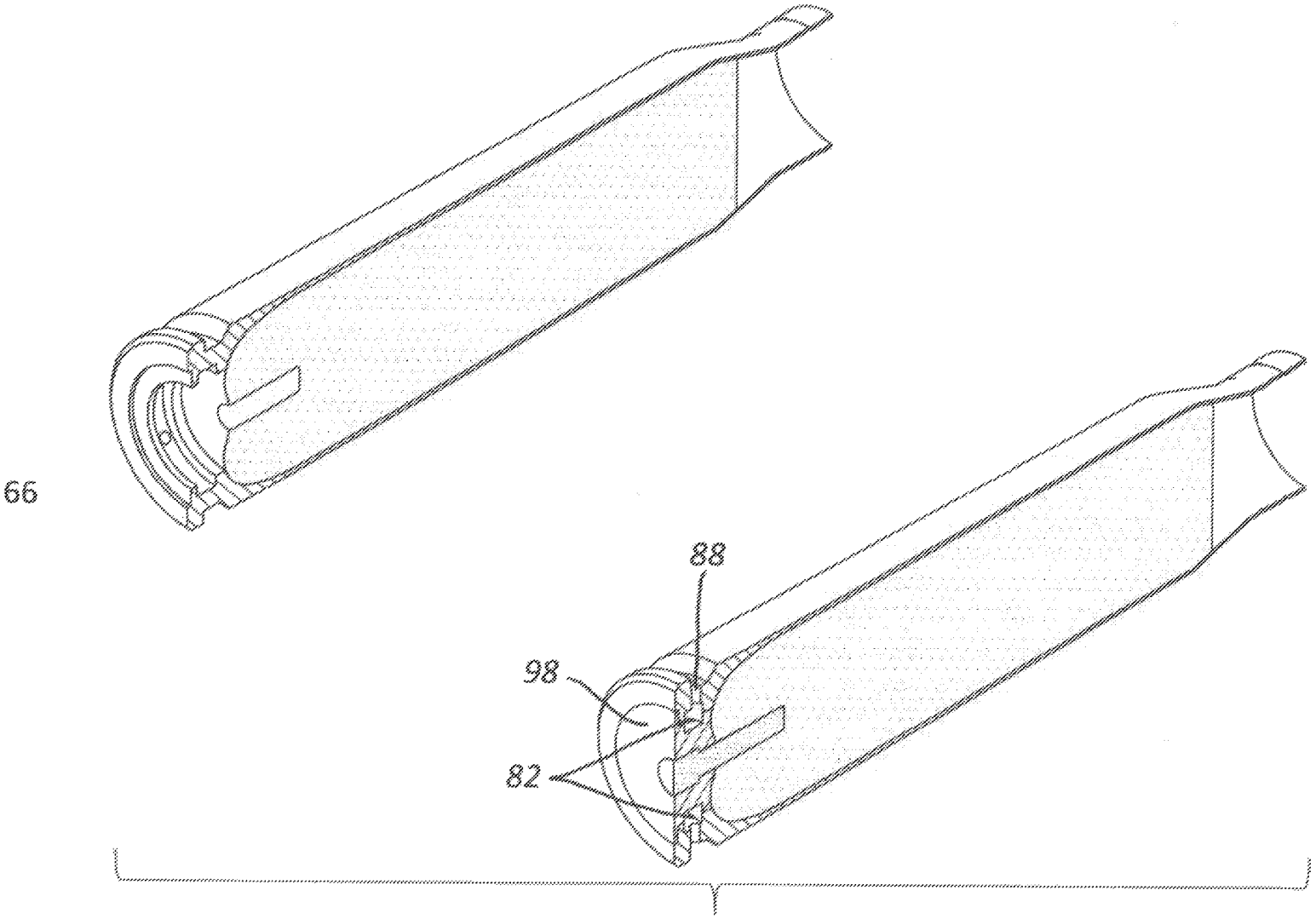
FIG. 2C depicts details of the metal body and vent in the cartridge case of the 30 mm cartridge of FIG. 2A, without the fusible material supporting the base plug revealing injection ports and cavities formed by seating and alignment of metal parts.
Figure 3A:
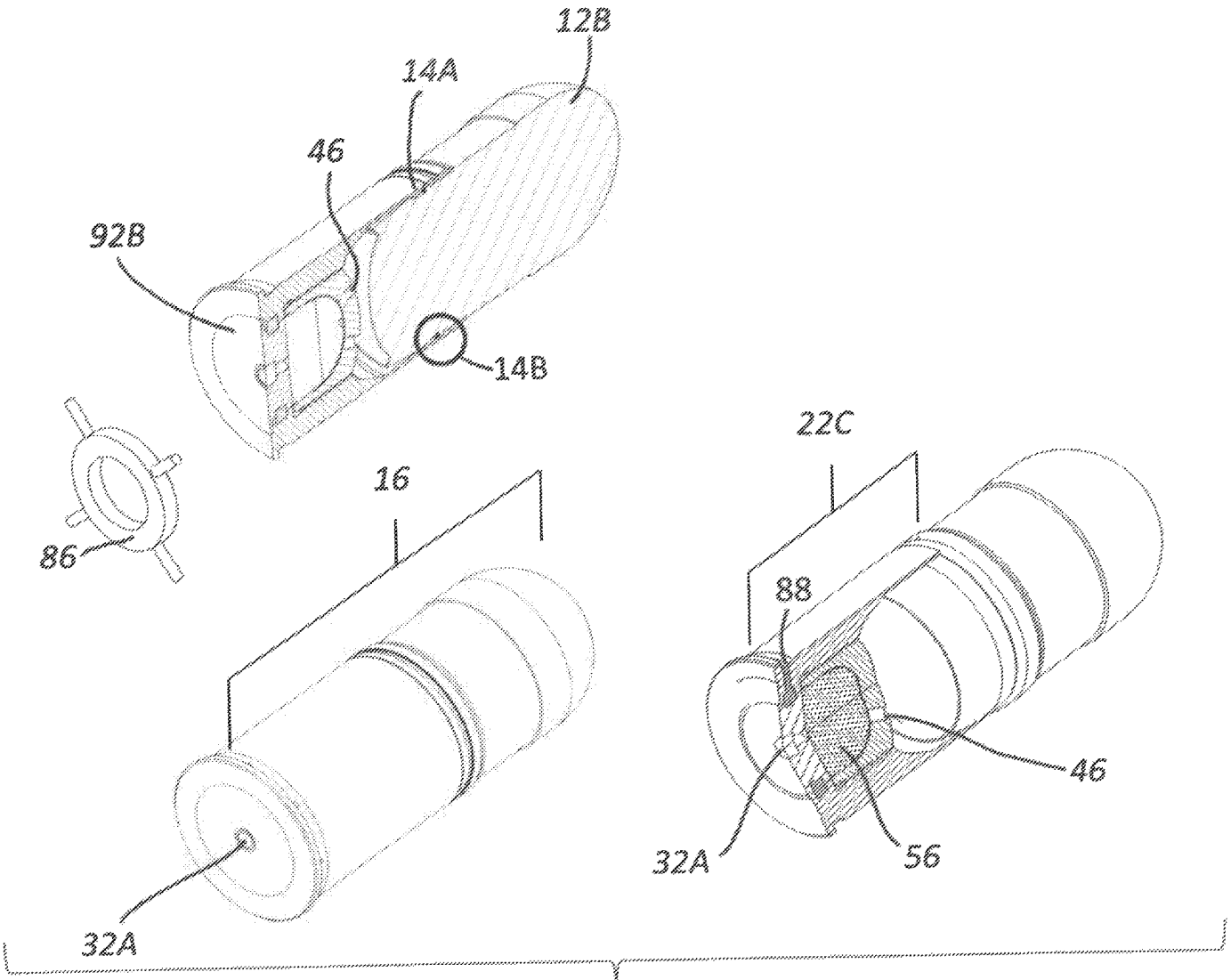
FIG. 3A depicts multiple perspective views of a 40 mm cartridge with a high-low propulsion and fusible polymer safety vent configured in the cartridge case assembly.
Figure 3B:
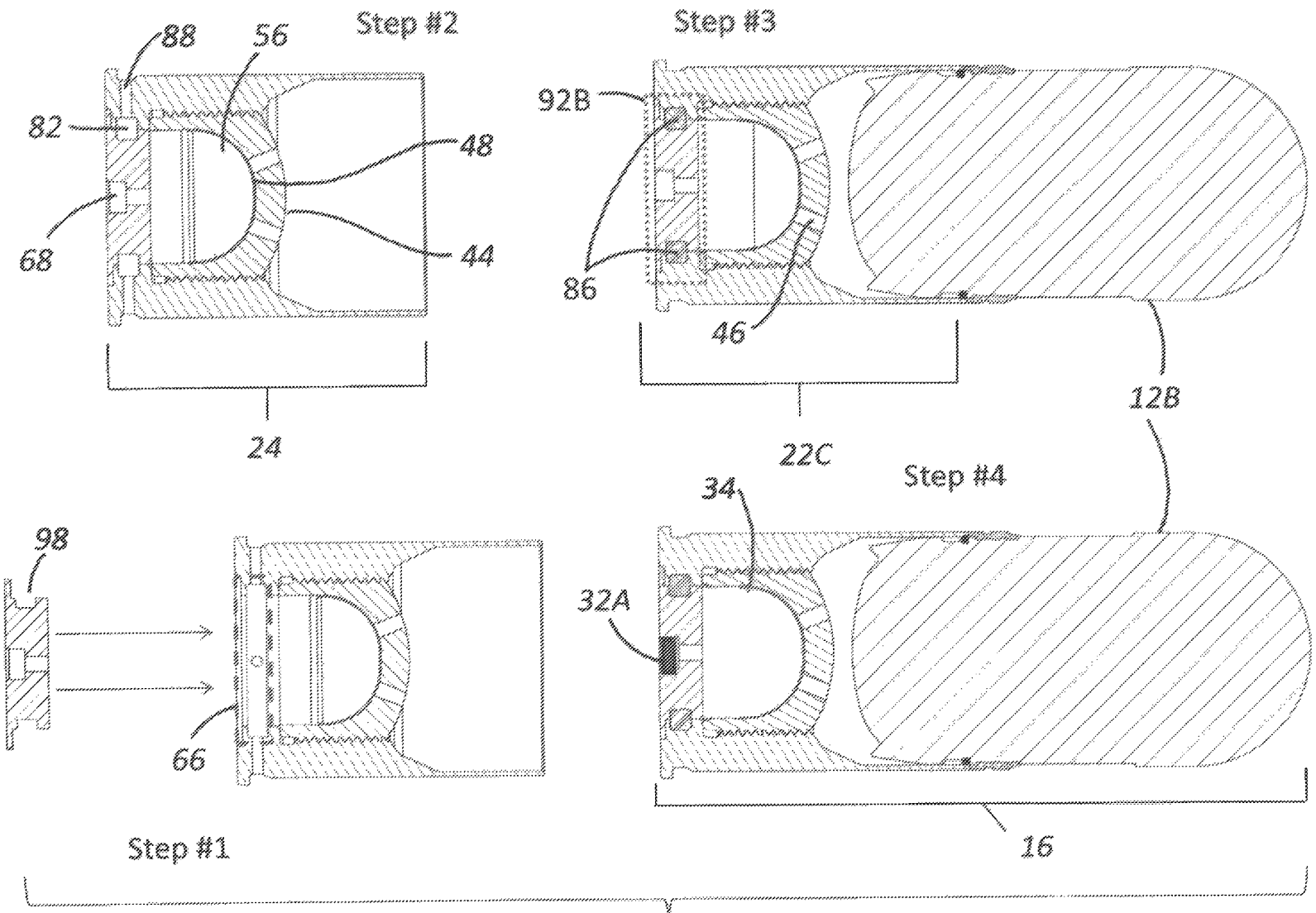
FIG. 3B shows cross-sectional views of a typical 40 mm cartridge with a multi-chamber propulsion with a fusible safety vent configured within the cartridge case assembly, setting forth manufacturing steps #1, #2, #3 and #4: #1 being a method step of inserting a plug into a seat, #2 positioning the base plug in a seat, forming a cavity and correctly aligning injection ports, #3 injecting a fusible material such as a polymer or liquid metal into ports to fill the cavity and produce a fusible support plug that congeals upon cooling the assembly, and #4 the steps of (1) loading of propellant and (2) inserting a primer in the sealed external wall of the propulsion chamber that incorporates a fusible plug adjacent to the base of the cartridge.

FIGS. 2C, 3A and 3B depict key features associated for the production of cartridge case assemblies 22, 22A, 22C, 22D that incorporate a fusible support plug 86 molded into the each cartridge case assembly 22A, 22C and 22D.

FIG. 3B illustrates sequenced production steps #1, #2, #3 and #4 that facilitate fabrication of the fusible support plug according to the invention. Step #1 illustrates how a metal plug, without fusible support 98, is aligned to be inserted to fit to a seat 66 in the cartridge case. In Step #2, the assembly of cartridge case sub-assembly 24 concurrently forms a safety vent cavity 82. In Step #3, a polymer is injected via ports 84 allowing cooling polymer to form in a fusible support plug 86 in a safety vent cavity 82. With the fusible support plug 86 incorporated, after cooling, a manufacturer can in Step #4 load a propellant 34, and fit a primer 92A into a primer seat 68, sealing the high pressure chamber 56 forming a completed cartridge case assembly 22C. FIGS. 2B and 3B illustrate fusible base plugs 86 incorporated into cartridge case assemblies 22.

During assembly, a projectile 12 may be affixed 14 to a cartridge case assembly 22 in either an initial or a final step of fabrication. It is also noteworthy that the assembly process may include insertion of a retention feature or component 72 and a cap 74 (FIG. 2B) covering the injection ports. In Step #4, the propellant is loaded via the primer seat 68 into a high pressure chamber 56 and a primer is positioned in the primer seat 68 closing the projectile and completing fabrication of a base vented cartridge 16 (FIG. 3B). The projectile 12B, assembled to the cartridge case assembly 22C may be sequenced prior to or after Step #4 by use of a seal 14 that may include a crimp 14A or use of an O-ring 14B (FIG. 3A).

Incorporation Fusible Support Plugs into Base Plugs

Figure 3C:
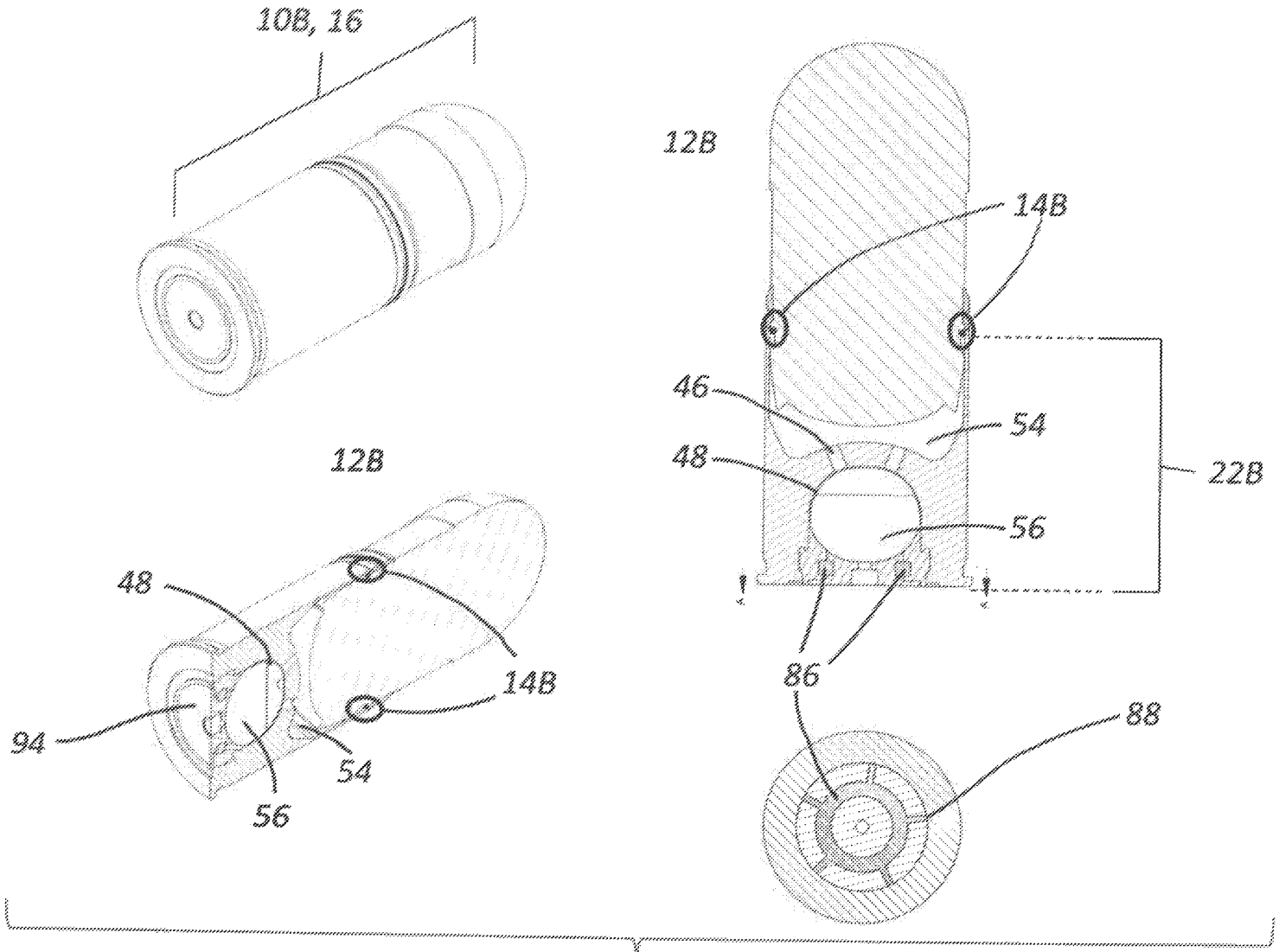
FIG. 3C depicts images of a U.S. M169 cartridge case with a "high-low" dual chamber propulsion formed by using modified base plug that incorporates a fusible support plug inside of the base plug.
Figure 3D:
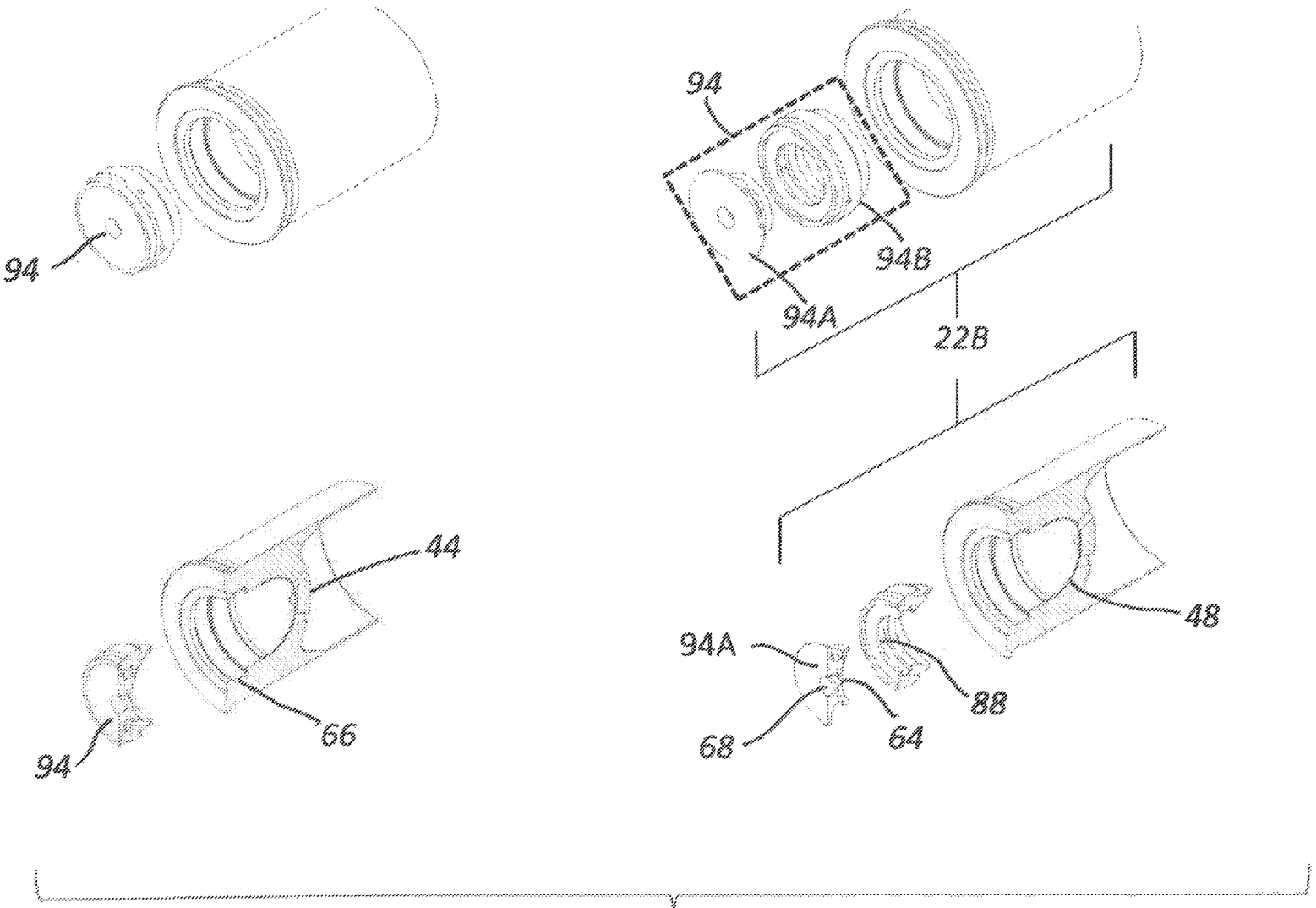
FIG. 3D depicts additional detail a modified U.S. M169 propulsion including exploded views with a dual chamber high-low propulsion of metal components for a crimped base plug with a fusible support plug.
Figure 3E:
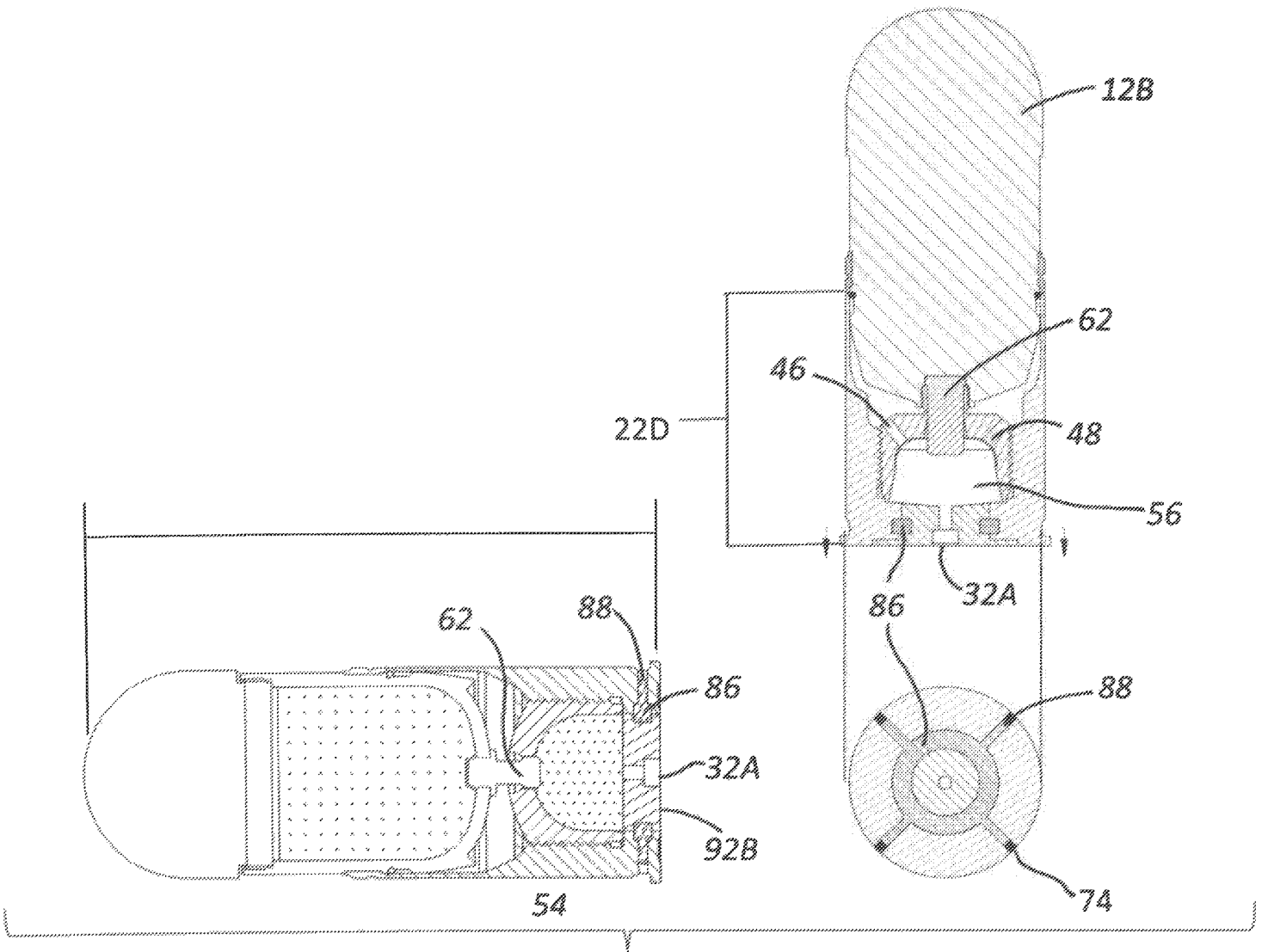
FIG. 3E depicts cross-section views of a typical "Nico" type cartridge case with a base plug and fusible support plug incorporated into the base of a cartridge case.

An alternate construction is provided for in FIGS. 3C and 3D, where a fusible support plug 86 is incorporated into a crimped base plug 26A using a special base plug sub-assembly 94. This sub-assembly is fabricated with inner safety lid 94A. The metal components, when partially assembled, provides for mating of an outer ring 94B and safety lid 94A. Notably, the outer ring has injection ports 88 allowing for assembly by injection molding of a fusible support plug 86 in a safety vent cavity.

Heating, Safety Plug and Venting

FIGS. 1, 2A-D and 3A-E, 6 and 7, in combination, show a safety vent fabrication and contingency vent activation that takes place in an emergency situation where a fire heats ammunition cartridges. In these circumstances, a base vented cartridge 16 will vent gases and burning propellants. Modification of the packaging will allow such a cartridge to vent when stored in a packaged configuration 102. Notably, venting only functions in circumstances when the cartridges or packaged cartridges are exposed to continuous heating imparted by an external fire. In these circumstances a cartridge's temperature rises above the maximum storage temperature 124, and the continuous heat soaks 132 of the cartridge case metal body 22 raises the temperature 134 of the fusible support plug's material 86 above the plug's phase change temperature 126. The resulting phase change (liquefaction) of the fusible material surrounding the base plug compromises the structural integrity of the high pressure chamber. Concurrently, continuous heating of the propellant produces out-gassing pressuring the compartment such that the pressure ejects the plug 26 from the cartridge case assembly 22 creating a vent channel 96.

Figure 2D:
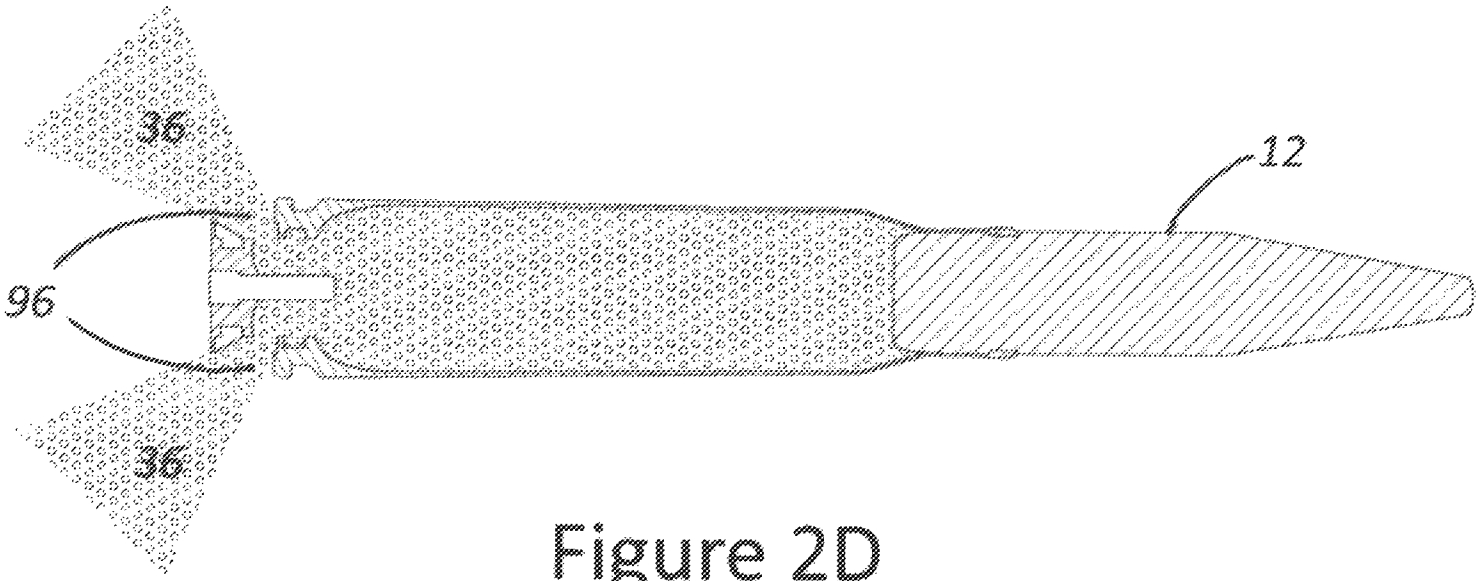
FIG. 2D is a cross-sectional view of a cartridge exposed to an external fire and activating a safety vent, releasing burning and unconfined propellant gases from the base of the cartridge.

Alternatively, heating produces propellant auto-ignition event 128 which ejects the base plug 26 to create a clear vent channel 36. A cross-section illustration of the resulting safety vent function is illustrated in FIG. 2D. In these circumstances a vent channel 96 is produced as venting combustion gases 36 escape from the cartridge case assembly 22A at an auto-ignition temperature 128.

Alternatively, where adequate propellant out-gassing occurs at an elevated temperature 124, off-gassing from the propellant pressurizes the chamber and the weakened fusible support plug 92 ejects the plug 98 from the cartridge case assembly 22, 22A, 22B, 22*c*, 22D. In these circumstances, the base plug 92C is ejected by pressurization of off-gassing (or ignition of combustion gases) 36. As the propellant does not combust in a pressurized vessel, the vent compromises the efficiency of the propellant burn and severity of the energetic event.

Multi-Chamber Configurations

FIG. 3A depicts a 40 mm cartridge with a dual or multi-chamber system with a high pressure chamber 56 and a low pressure chamber 54 where propellant combustion takes place. It is also possible to utilize this methodology for a three chamber propulsion system.

References 3A-3E illustrate other 40×53 mm cartridge configurations with low pressure chamber 54 and high pressure chamber 56 utilizing the techniques identified in this specification. Various configurations may incorporate chamber wall 44, burstable liners 48, and High to Low/Interim Pressure vent orifices 46. A dual chamber case may include a toggle 62 that throttles the passage of propellant, combustion gases into the low pressure chamber 46.

A 40 mm HV cartridge case assembly 22B, 22C and 22D, may include a dual or multi-chamber system with chamber walls 44 where a multi-chamber system includes at least one higher chamber system with a orifice 46. In normal operation, the expanding propellant gases combust in the high pressure chamber bursting a liner 48 or push a toggle component 62 and then pass thru an orifice 46 channeling gases into a low pressure chamber 54. FIG. 3D depicts cross-sectional and perspective views of a preferred cartridge case sub-assembly 24, without energetic components 32A, 32B, 34.

Form and Injection Molding Fusible Materials into Ports, Channels and Cavities for Safety Plug Fabrication A preferred assembly process forms a multi-chamber cartridge with a high pressure chamber 46 with a safety vent cavity 82 where a fabricator can inject a fusible material, preferably a polymer, via ports 88 and molding channels 84 completing fabrication of a cartridge case sub-assembly 24. In fabrication, such a cartridge case and the incorporated fusible support plugs is held in position within the base plug seat 66. The configuration allows the fabricator to first assemble non-energetic components; in a second step to load the propellant 34 into the high pressure chamber 56 via a passage 64 and, in a third step, position and seal the primer or an igniter 32A allowing for automated assembly of a cartridge case 22.

Dunnage and Vented Packaging

Figure 4:
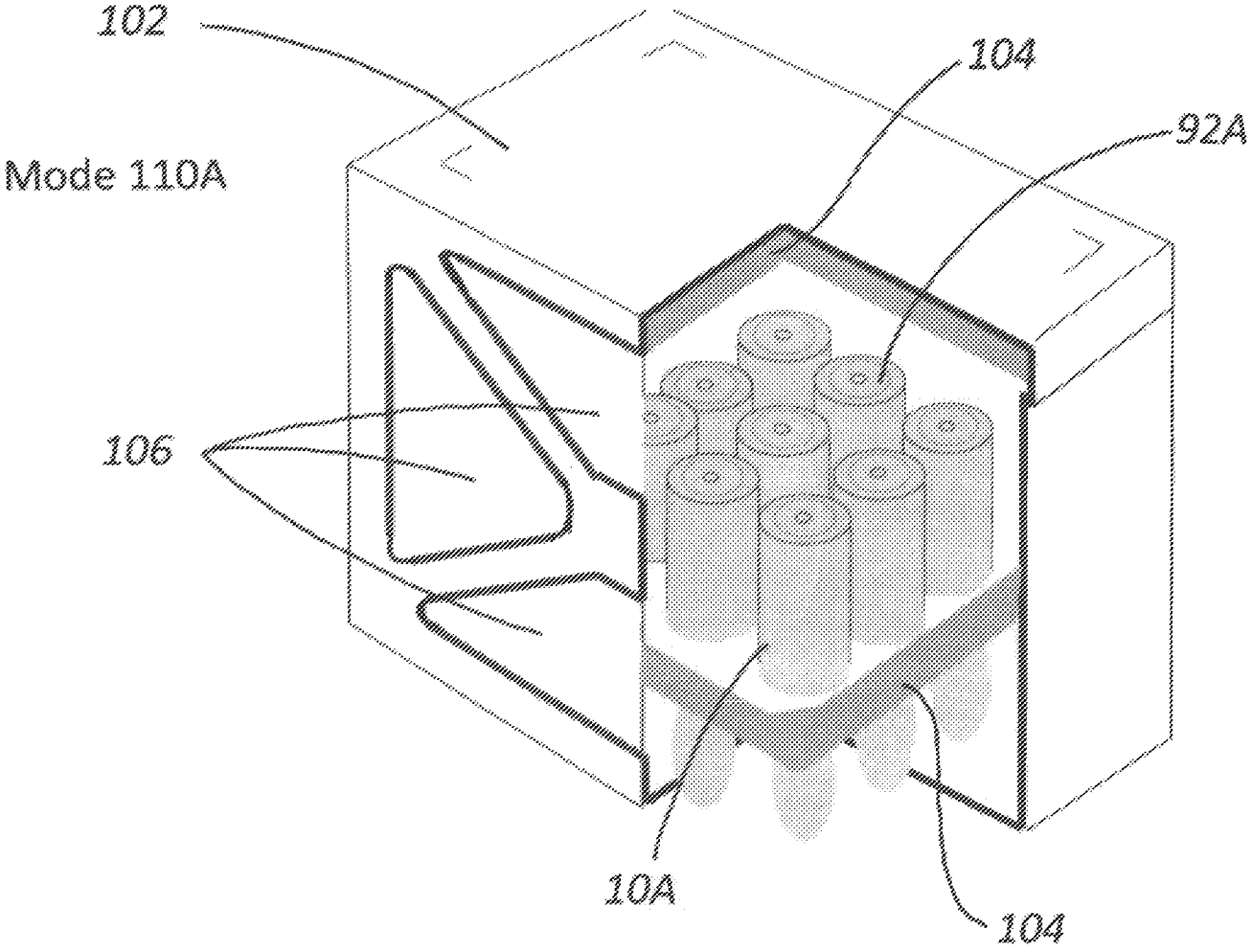
FIG. 4 depicts a perspective, sectioned view of an ammunition packaging container filled with 30 mm ammunition cartridges and dunnage in a logistic package, storage mode. The ammunition box has "blow-out panels" in a wall section.
Figure 5:
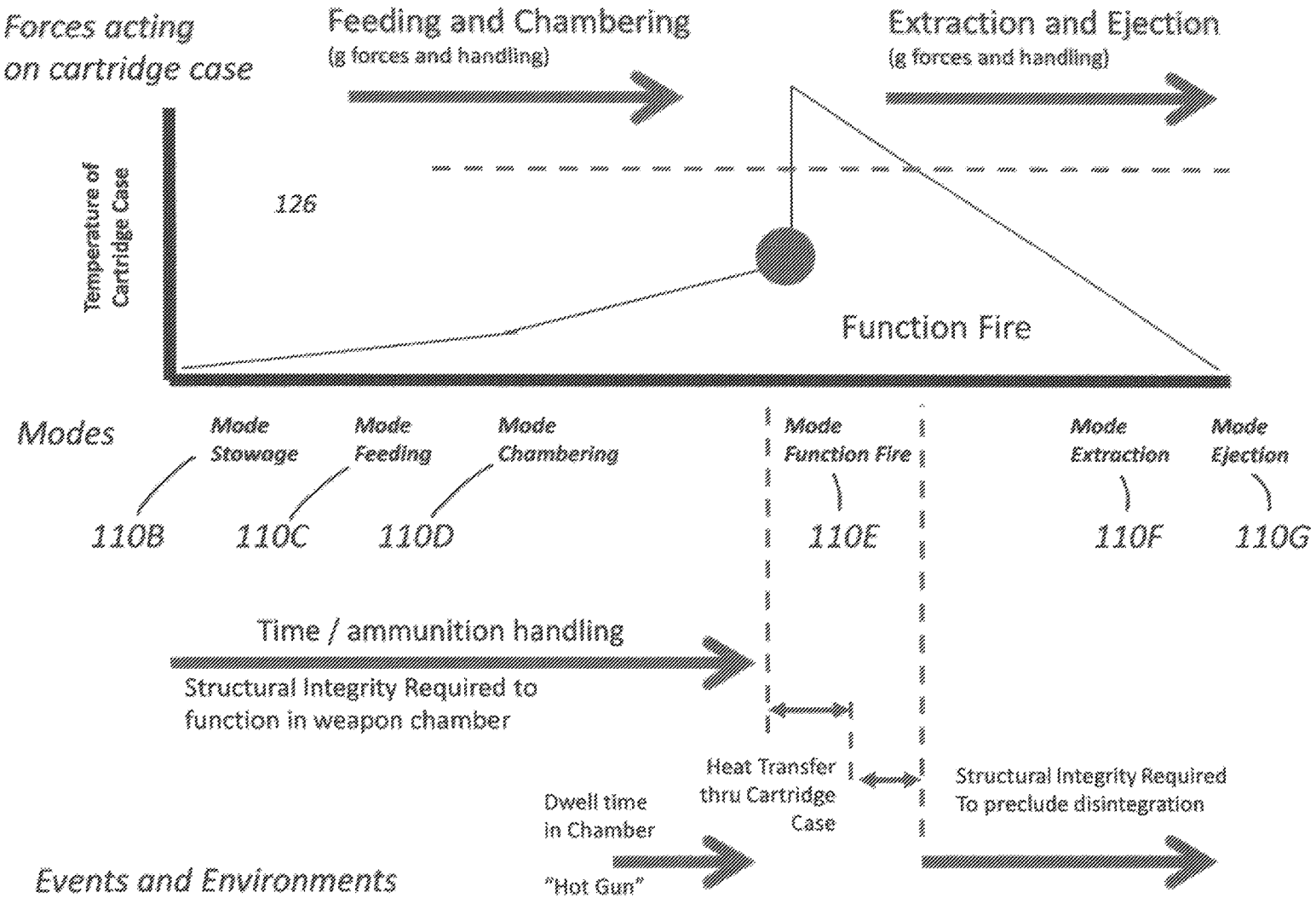
FIG. 5 depicts forces and environments at different modes of medium caliber military ammunition, after being unpackaged and loaded into a tactical stowage configuration. Modes of normal use include feeding, chambering, function fire, extraction and ejection typical of cannon and machine gun handling.
Figure 6:
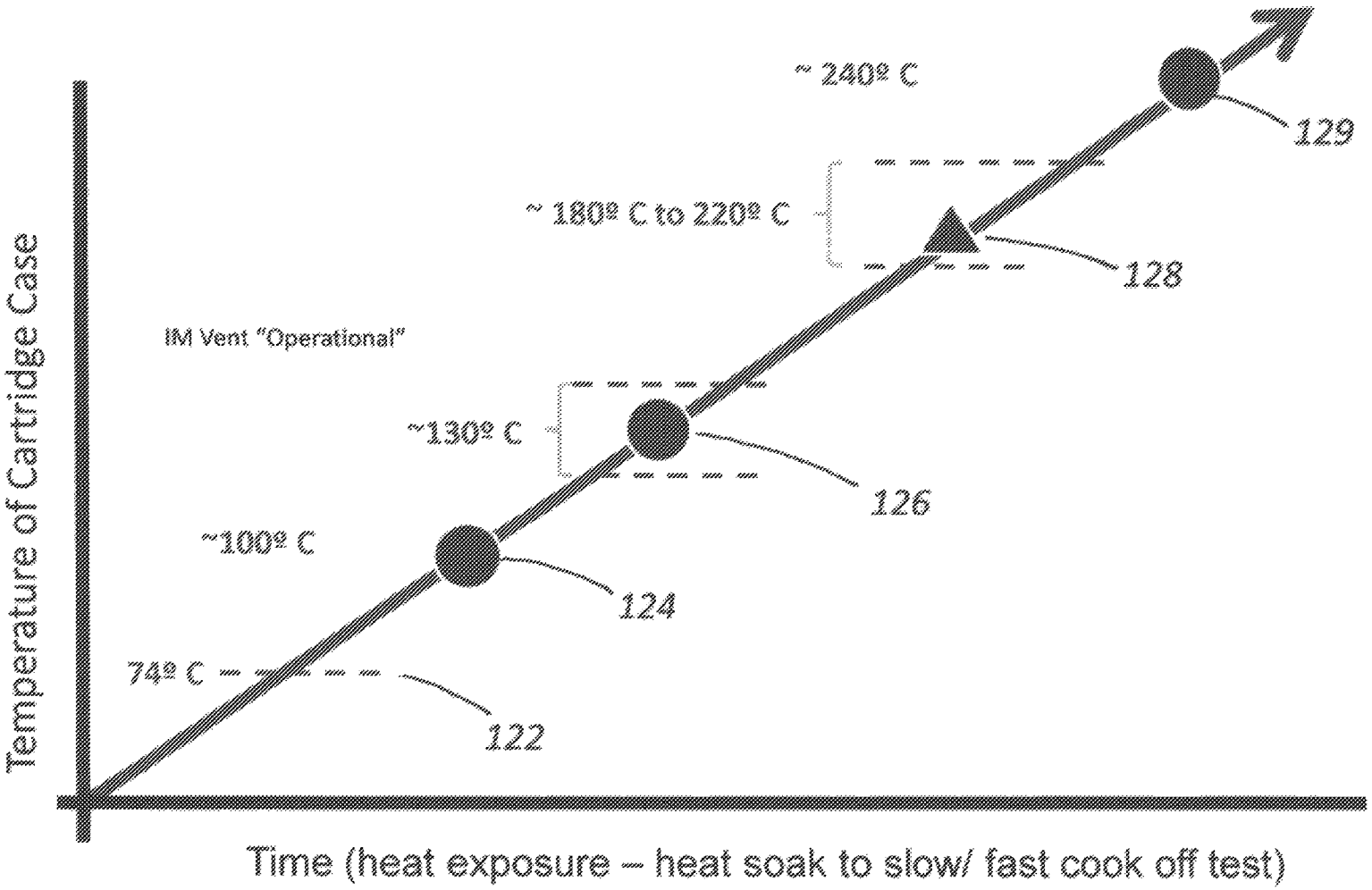
FIG. 6 is a graph illustrating how continued heating over time (heat soaking) elevates the temperature of a cartridge. The graph annotates predictable activation and events and nominal temperatures when progressive heating is applied to a cartridge case. An 1M safety vent activates at a predicted temperature prior to an energetic event initiating propellant burn, such that the safety vent is activated to vent gases from the base of a cartridge munition.
Figure 7:
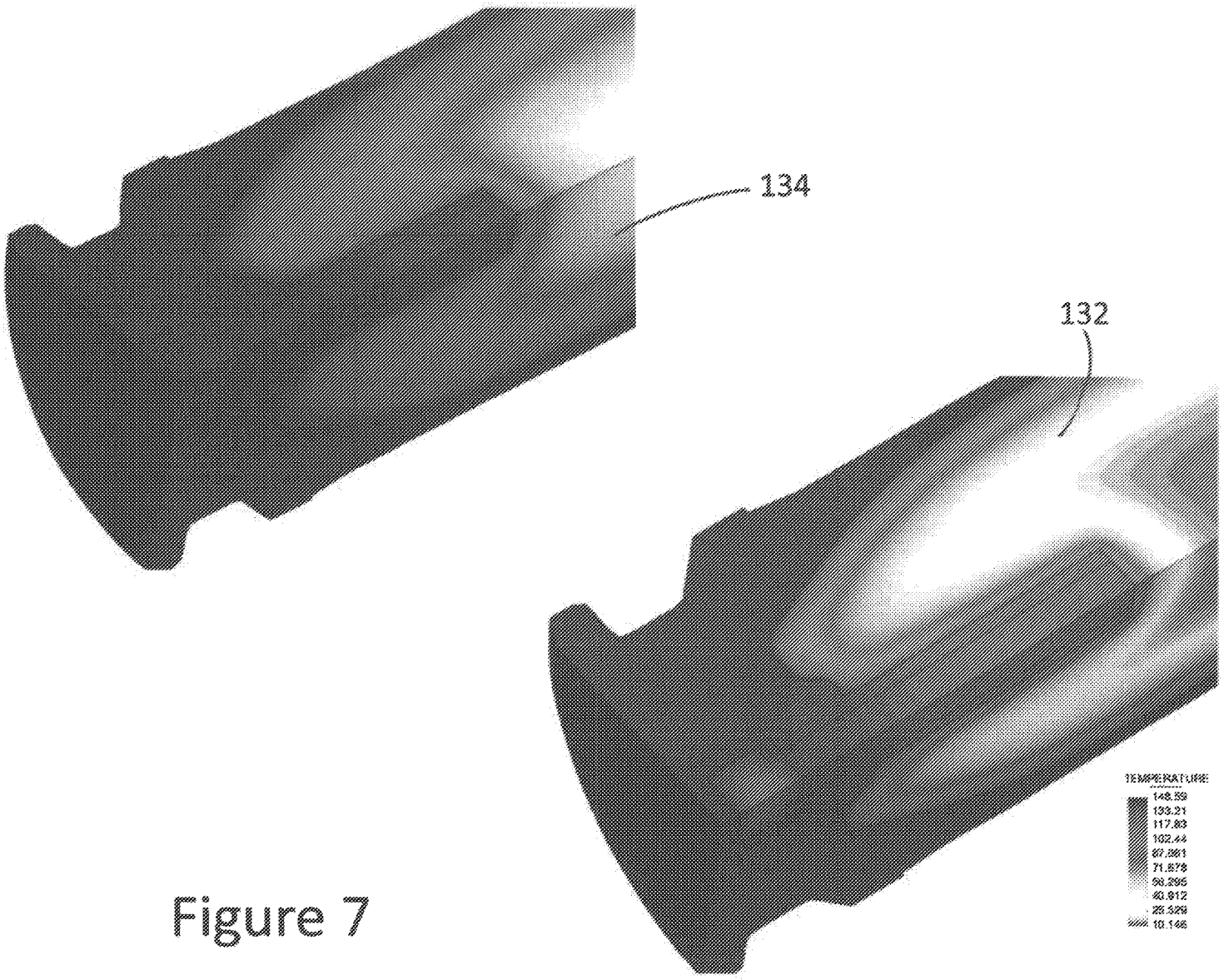
FIG. 7 depicts two grey-scale views of a 30 mm cartridge being heated above maximum storage conditions (heat soaking).

With reference to FIG. 4, it is preferred that in the logistics packaging configuration, combustion gasses are released from the vented cartridge 16, cascading momentarily into a vented packaging container 102, and thereafter transiting and escape into the atmosphere though blow-out panels 106 configured in the packaging 102. The dunnage 104 in a vented packaging container must not melt or clog the cartridge vent channels 26. The combination of base vented cartridges and special dunnage are configured to preclude obstruction of vented cartridges and facilitating transit of gases from the cartridge, into the container and then, via blow-out panels 106, into the atmosphere in a semi-controlled and predictable manner.

Hot Gun Chamber Performance and Retention Features

With reference to FIGS. 2C and 5, a typical cartridge must function in normal operation which can be defined as modes of use and function: logistics storage 110A, feeding 110B, chambering 110C, function fire 110D, extraction 110E and ejection 110F. Open bolt weapons normally have minimal dwell time. Closed bolt weapons, by contrast, may chamber cartridges in a "hot gun chamber" condition 110C with a dwell time allowing heating of the unfired cartridge. Accordingly, some improved cartridge designs 16 may include a retaining feature 72, 74 or 76 that will preclude inadvertent disintegration during extraction 110E and ejection 110F.

There has thus been shown and described a novel ammunition cartridge fitted with a base plug that will initiate contingent venting which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

REFERENCE NUMERALS

Ammunition Cartridge Overview
10 Cartridge
30 mm Cartridge
40 mm Cartridge
12 Projectile
12A 30 mm Projectile
12B 40 mm (HV) Projectile
14 Cartridge to Projectile Seal
14A Crimp
14B O-Ring
16 Base Vented Cartridge
Cartridge Case Assembly Types and Features
22 Cartridge Case Assembly
22A 30 mm×173 Cartridge Case Assembly
22B 40 mm×53 Cartridge Case US M169 Assembly
22C 40 mm×53 Cartridge Case Typical Crimped Assembly
22D 40 mm×53 Cartridge Case Assembly with Toggle
24 Cartridge Case Sub Assembly
26 Cartridge Case Base
26A Crimped Base Plug
28 Cartridge Case Rim
Energetic Material
32A Primer or Igniter
32B Flash Tube
34 Propellant
36 Combustion gas venting
38 Energetic auto-ignition
Special Propulsion Features
44 Chamber Wall
46 High to Low/Interim pressure orifice
48 Burstable Liner (Multi-Chamber System)
Operational Chambers
52 Single Chamber
54 Low Pressure Chamber
56 High Pressure Chamber
Typical Metal Propulsion Component Features
62 Toggle
64 Passage
66 Base Plug Seat
68 Primer Seat
Vent Retention Feature
72 Crimp, Stake or Wire
74 Cap
Safety Vent Features
82 Safety Vent Cavity
84 Injection Molding Channels
86 Fusible Support Plug
88 Injection Ports for fusible material
Safety Vent Feature Configured in a Cartridge Case Assembly
92 Base with Fusible Support Plug
92A 30 mm Base and Fusible Support Plug
92B 40 mm Base and Fusible Support Plug
94 40 mm Base Plug Sub Assembly with inner Safety Vent Feature
94A Inner Vent Lid for a Base Plug Assembly
94B Outer Ring for a Base Plug Assembly
96 Activated Vent Channel
98 Plug sans fusible support
Ammunition Packaging Features
102 Packaging Container
104 High Temperature Melt Dunnage
106 Blow-out panel
Ammunition States and Modes of Use and Handling
110A Mode—Cartridges in packaged condition
110B Mode—Cartridge in stowage
110C Mode—Cartridges in extraction and feeding
110D Mode—Cartridges undergoing chambering

110E Mode—Cartridges in function fire in gun breach or chamber

110F Mode—Extraction of "spent" cartridge case

110G Mode—Ejection of "spent" cartridge case

Key Venting Temperature Ranges

122 Maximum Storage Temperature

124 Out gassing Temperature

126 Phase Change Temperature

128 Energetic Event (a) Propellant Auto-ignition, (b) Primer Auto-ignition or (c) Igniter Auto-ignition

129 Melt Temperature of dunnage in packaging container.

Heat Transfer

132 Initial Heating of Cartridge Case Assembly

134 Elevated Heating of Cartridge Case Assembly in a heat soak

What is claimed is:

1. A method of manufacturing a base vented ammunition cartridge comprised of a projectile inserted in, and mechanically connected to, a metal cartridge case assembly having a propulsion chamber and a cartridge case base that houses an energetic propellant disposed in the propulsion chamber;

wherein the cartridge case base includes at least one fusible support plug that creates a vent channel that is activated only when the cartridge is heated and reaches an elevated temperature;

said method comprising the steps of:

(a) inserting a plug sans fusible support into a base plug seat, wherein the inserting the plug into the base plug seat forms a safety vent cavity at an inner end of an injection port of the cartridge case base, the safety vent cavity formed partly in the plug and partly in the cartridge case base;

(b) injecting a fusible material into the safety vent cavity via the injection port;

(c) molding, cooling and solidifying the fusible material at ambient temperature, wherein the cooling and solidifying the fusible material allow the metal cartridge case assembly and the plug to be bonded together;

(d) forming a fusible support plug that creates a complete base therewith, and (e) inserting an energetic igniter or primer in a primer seat of the ammunition cartridge.

2. The method of claim 1, wherein the fusible material is a polymer.

3. The method of claim 1, wherein the fusible material is a fusible metal.

4. The method of claim 1, wherein the base vented cartridge case has injection ports via which the fusible material is injected under pressure and injection-molding channels.

5. The method of claim 1, further comprising:

inserting a retention feature covering the injection port.

6. The method of claim 1, wherein the fusible support plug is incorporated into the plug using a base plug sub-assembly fabricated with inner safety lid and wherein metal components of the sub-assembly, when partially assembled, provides for mating of an outer ring and the safety lid.

7. The method of claim 6, wherein the outer ring has the injection port allowing for assembly by injection molding of the fusible support plug in the safety vent cavity.

8. The method of claim 1, wherein, when the base vented ammunition cartridge is subjected to high temperature above maximum storage temperature, the fusible support plug softens and when the energetic propellent produces an energetic combustion, the vent channel is activated and releases combustion gases via the vent channel.

9. The method of claim 1, wherein the propellent chamber of the base vented ammunition cartridge comprises a high pressure chamber and a low pressure chamber.

10. The method of claim 9, wherein the propellent chamber includes a toggle that throttles passage of propellant, combustion gases into the low pressure chamber.

11. The method of claim 1, wherein the propellent chamber of the base vented ammunition cartridge comprises a high pressure chamber, a low pressure chamber and an intermediate pressure chamber.

12. The method of claim 11, wherein at least one of the high pressure chamber and an intermediate pressure chamber include an orifice.

13. The method of claim 12, wherein in normal operation, expanding propellant gases combust in the high pressure chamber and channels the gases into the low pressure chamber through the orifice.

* * * * *